US006648047B2

(12) United States Patent
Kimmet

(10) Patent No.: US 6,648,047 B2
(45) Date of Patent: Nov. 18, 2003

(54) SECURITY SYSTEM FOR A CUBICLE

(76) Inventor: Stephen G. Kimmet, 118 Gross St., Tiffin, OH (US) 44883

( * ) Notice: Subject to any disclaimer, the term of this patent is extended or adjusted under 35 U.S.C. 154(b) by 0 days.

(21) Appl. No.: 10/175,130

(22) Filed: Jun. 19, 2002

(65) Prior Publication Data

US 2003/0029576 A1 Feb. 13, 2003

Related U.S. Application Data

(63) Continuation of application No. 10/068,021, filed on Feb. 5, 2002, which is a continuation of application No. 09/524,339, filed on Mar. 13, 2000, now Pat. No. 6,378,592.

(60) Provisional application No. 60/124,613, filed on Mar. 16, 1999.

(51) Int. Cl.[7] ..... A47H 5/00

(52) U.S. Cl. ..... 160/84.04; 160/84.01; 160/84.08

(58) Field of Search ..... 160/84.01, 84.04, 160/84.08, 84.11, 265, 274, 330, 213, 902, DIG. 16

(56) References Cited

U.S. PATENT DOCUMENTS

| | | | | |
|---|---|---|---|---|
| 3,223,147 A | | 12/1965 | Holloway | |
| 3,785,695 A | * | 1/1974 | Conkle | 296/50 |
| 3,792,885 A | | 2/1974 | Giardina et al. | |
| 3,797,005 A | | 3/1974 | Schwarz | |
| 3,919,808 A | | 11/1975 | Simmons | |
| 3,979,861 A | * | 9/1976 | Fromme et al. | 52/71 |
| 4,027,714 A | * | 6/1977 | Dixon et al. | 160/84 R |
| 4,320,933 A | | 3/1982 | Felix et al. | |
| 4,620,581 A | * | 11/1986 | Wallace | 160/187 |
| 4,856,843 A | * | 8/1989 | Elliott | 296/181 |
| 4,953,610 A | | 9/1990 | Phillips et al. | |
| 5,307,858 A | * | 5/1994 | Turner | 160/213 |
| 5,308,157 A | | 5/1994 | Dyer | |
| 5,323,834 A | | 6/1994 | Toti | |
| 5,351,737 A | | 10/1994 | Hoshiyama | |
| 5,365,991 A | | 11/1994 | Wright et al. | |
| 5,447,345 A | | 9/1995 | Daley | |
| 5,456,303 A | | 10/1995 | Horinouchi | |
| 5,570,940 A | * | 11/1996 | Maro | 312/257.1 |
| 5,762,123 A | | 6/1998 | Kuyama et al. | |
| 5,864,988 A | | 2/1999 | Frederick | |
| 5,873,401 A | | 2/1999 | Tsuchida | |
| 5,901,767 A | * | 5/1999 | Ralton et al. | 160/84.04 |
| 6,047,760 A | | 4/2000 | Judkins | |
| 6,079,472 A | | 6/2000 | Schanz | |
| 6,119,755 A | | 9/2000 | Oskam | |
| 6,176,292 B1 | * | 1/2001 | Norton, II | 160/206 |
| 6,253,826 B1 | | 7/2001 | Witter et al. | |
| 6,283,189 B1 | * | 9/2001 | Liebscher | 160/9 |
| 6,378,592 B1 | * | 4/2002 | Kimmet | 160/84.04 |

FOREIGN PATENT DOCUMENTS

DE 3500572 A1 7/1996

* cited by examiner

*Primary Examiner*—Bruce A. Lev
(74) *Attorney, Agent, or Firm*—Marshall & Melhorn, LLC

(57) ABSTRACT

A collapsible security system includes a door having a plurality of collapsible panels. The security system can be mounted from a cubicle partition or a wall frame of a door. In the compressed position, the door of the security system allows access to the office space within the cubicle or room. When the panels are expanded and connected to the opposite frame of the cubicle partition or an opposing door, the security system no longer allows access to the office space. In another embodiment, the security system includes a locking bar that allows the panels to stay in the expanded position. In addition, two opposing panel doors can be mounted to a wall frame using spring-loaded hinges to allow the panel doors to swing open and closed. The door panels can be rectangular or decorative shape with permanent or removable decorative or descriptive panels.

16 Claims, 3 Drawing Sheets

SECURITY SYSTEM FOR A CUBICLE

RELATED APPLICATIONS

This application is a continuation application of pending U.S. patent application Ser. No. 10/068,021, filed Feb. 5, 2002, which is a continuation application of U.S. Patent application Ser. No. 09/524,339, filed Mar. 13, 2000, now U.S. Pat. No. 6,378,592, which claims the benefit of U.S. Provisional Patent Application Serial No. 60/124,613, filed Mar. 16, 1999, which applications are all incorporated herein in their entirety.

BACKGROUND OF THE INVENTION

This invention relates in general to a security system for a door, and in particular, to a security system for a cubicle comprising an expandable/collapsible panel for mounting to the wall proximate to the cubicle opening.

A typical commercial and residential settings, such as in an office environment setting, office space for employees usually consists of a series of cubicles. The cubicles comprise one or more partitions that are attached to each other. An opening in the partitions form a doorway for the employee to enter the office space. One problem associated with this typical office environment is the theft of equipment when the employee is not present in the cubicle. Thus, there is a need for a security system for a doorway for use in commercial and residential applications that can be built and sold at a low cost, takes up very little room for storage, and can be adapted to existing cubicles at minimum cost.

SUMMARY OF THE INVENTION

One object of the invention is to provide a low cost system to secure an office cubicle.

Another object of the invention is to provide a new and better system to provide privacy for any kind of doorway or opening.

In one aspect of the invention, a security system comprises a door including a plurality of collapsible panels, a compression mechanism and a locking mechanism. The door is mounted to a wall frame for a cubicle partition. The compression mechanism is mounted to the wall frame for mounting the door to the wall frame. The compression mechanism includes a rope fed through at least one opening in the plurality of collapsible panels. The rope is fed through a pulley and has a weight attached to one end thereof. The locking mechanism locks the plurality of collapsible panels in place by frictionally engaging the rope. A decorative panel may be removably attached to the door to provide a more aesthetic appearance for the door.

In another aspect of the invention, a security system comprises a pair of opposing doors, a pair of spring-loaded hinges and a locking mechanism. Each door includes a plurality of collapsible panels. The pair of spring-loaded hinges are mounted to a wall frame for pivotally mounting each door to a cubicle partition. The locking mechanism may comprise a locking bar for locking the plurality of collapsible panels in place. A decorative panel may be removably attached to the door to provide a more aesthetic appearance for the door.

Various objects and advantages of this invention will become apparent to those skilled in the art from the following detailed description of the preferred embodiment, when read in light of the accompanying drawings.

DESCRIPTION OF THE PREFERRED EMBODIMENT

Figure 1:
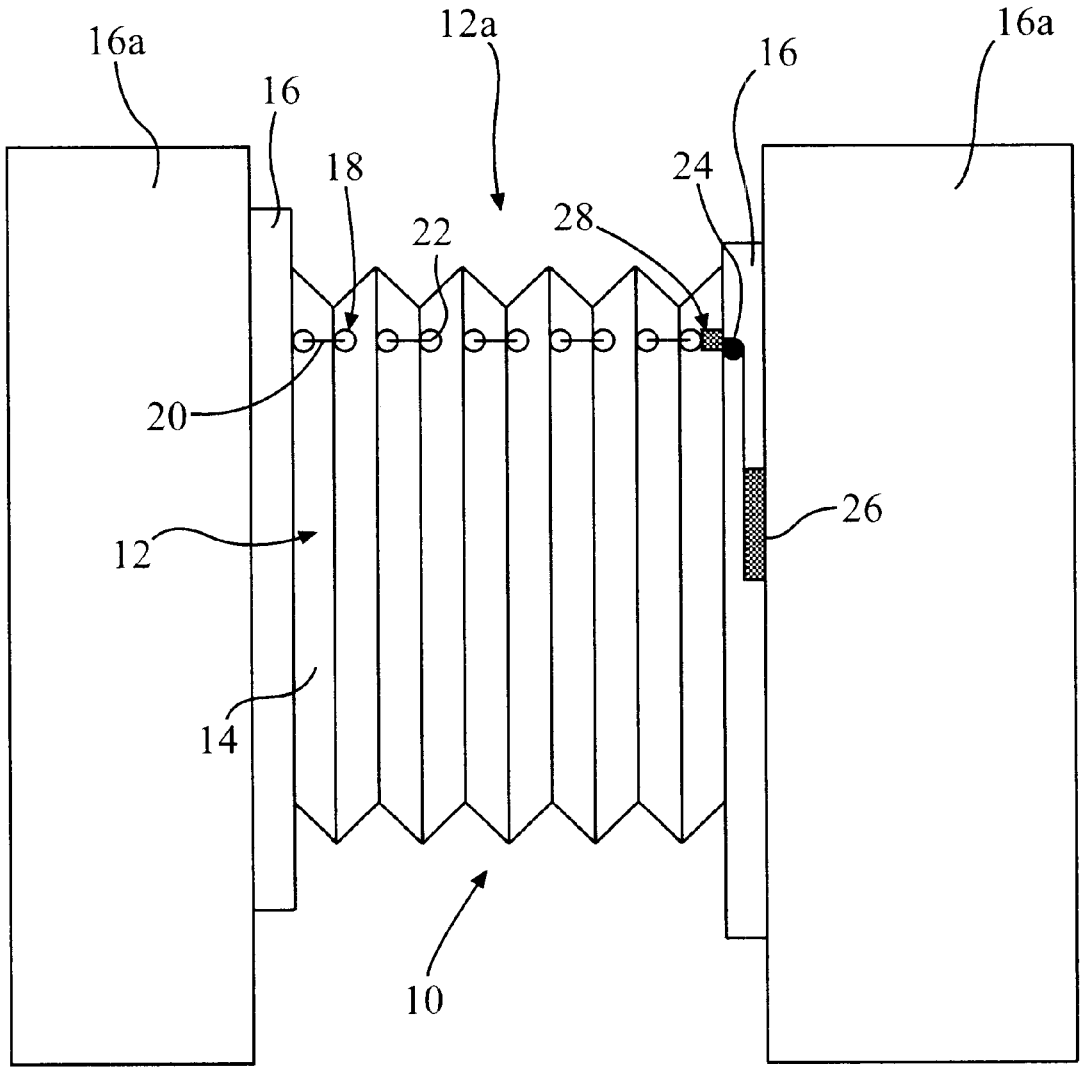
FIG. 1 shows a security system for a cubicle comprising a single collapsible door system with the automatic compression mechanism according to a first embodiment of the invention.

Referring now to the drawings, there is illustrated in FIG. 1 a security system for a cubicle, and the like, shown generally at 10, according to a first embodiment of the invention. In general, the security system 10 includes a single collapsible door 12 formed of a plurality of collapsible panels 14 attached to a wall frame 16 for a cubicle partition or wall 16*a*. The collapsible door 12 can be made with an automatic compression mechanism, shown generally at 18. The automatic compressing mechanism 18 comprises a rope 20 passing through a plurality of holes 22 formed in the door 12. Preferably, one hole 22 is formed in each panel 14. One end of the rope 20 can be attached to the collapsible panel 14 farthest from the wall frame 16. The rope 20 can be looped over a pulley 24 proximate to the collapsible panel 14 nearest to the wall frame 16. Preferably, the pulley 24 is mounted within the wall frame 16 to conceal the pulley 24. The other end of the rope 20 can be attached to a weight 26, which can be also concealed within the wall frame 16. A lock mechanism, shown generally at 28, can be mounted on the wall frame 16. The lock mechanism can use any well-known means in the art to frictionally engage the rope 20, such as a clamp, and the like. The lock mechanism 28 can have two positions: (1) the lock mechanism 28 allows the rope 20 and the panels 14 of the door 12 to expand and collapse freely, and (2) the lock mechanism 28 does not allow the rope 20 and the panels 14 to move freely, which will keep the panels 14 from expanding and collapsing freely. In this manner, the lock mechanism 28 can lock the panels 14 in place and can control the position of the door 12 within a door aperture 12*a*. If the lock mechanism 28 is put into the first position, gravity will cause the weight 26 to pull the door 12 to open the door 12 automatically.

Figure 2:
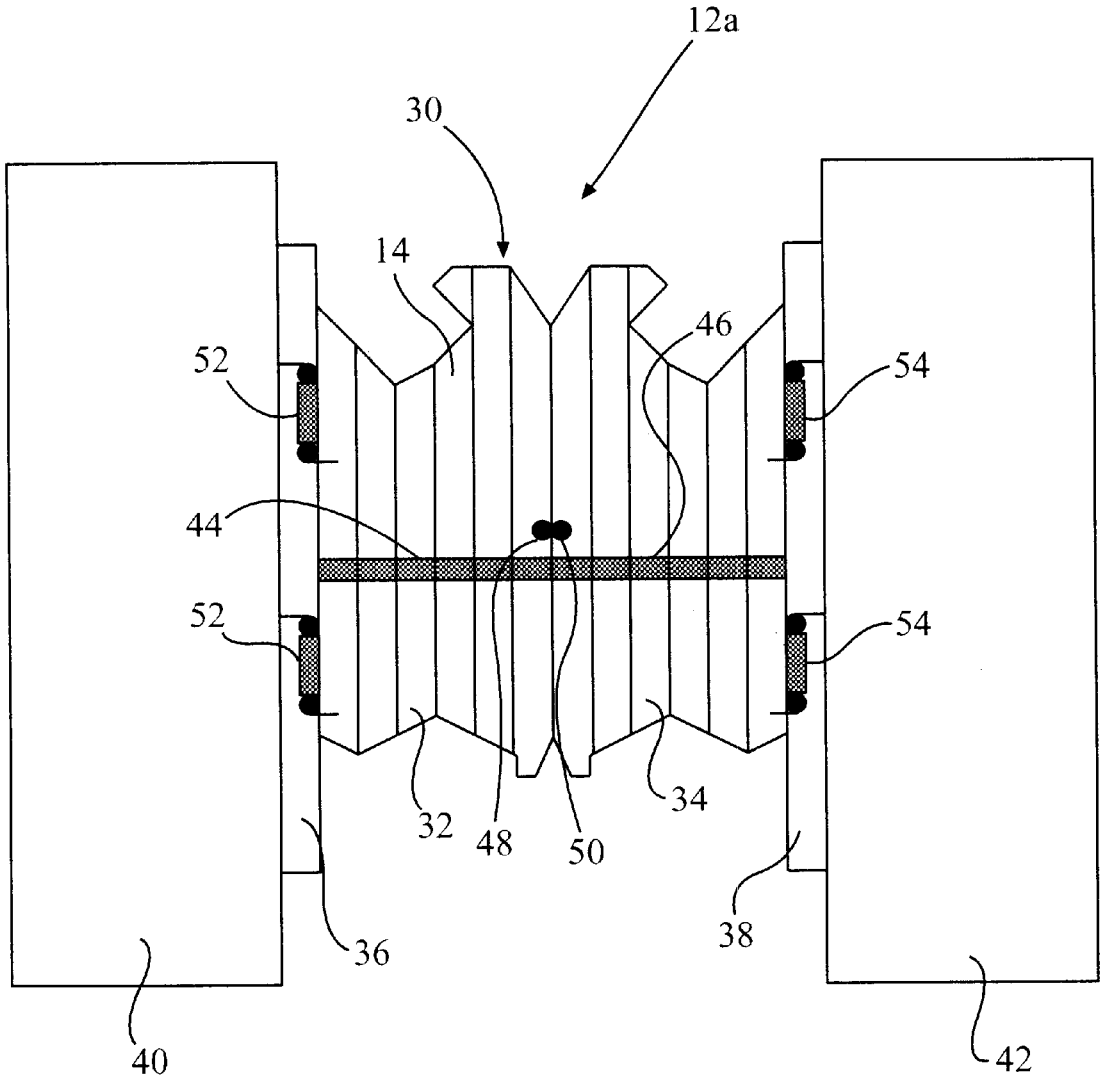
FIG. 2 shows a security system for a cubicle comprising two opposing collapsible door systems that join in the middle of the door aperture with locking bars and swing mechanisms to form a saloon style collapsible door security system according to a second embodiment of the invention.

FIG. 2 illustrates a security system, shown generally at 30, according to a second embodiment of the invention. In this embodiment, the security system 30 comprises a pair of opposing decorative saloon style collapsible doors 32, 34 with swing and locking bar capability. The collapsible doors 32, 34 are similar to the door 12 of the first embodiment in that each door 32, 34 is comprised of a plurality of panels 14. The respective wall frames 36, 38 for each door 32, 34 are mounted to a structure, such as walls or cubicle partitions 40, 42. When the doors 32, 34 are in the fully expanded position as shown in FIG. 2, a locking mechanism, such as a locking bar 44, 46 on each door 32, 34 can be pivoted into place across each door 32, 34. The locking mechanisms 44, 46 can then be placed into a locking position using means well known in the art, such as a pair of magnets 48, 50, at the farthest extended panel of each door 32, 34 (the door panel nearest the center of the door aperture) to cause each door 32, 34 to stay in the fully extended position.

Each door 32, 34 also has the ability to swing open and closed. This can be achieved by mounting each door 32, 34 to a pair of spring-loaded hinges 52, 54. The hinges 52, 54 are preferably mounted between the wall frames 36, 38 and the collapsible panels 14 of the doors 32, 34. When the doors 32, 34 are locked into the fully expanded position by use of the locking bars 44, 46 and a force is applied to the extended panels 14, the doors 32, 34 will swing open. When a force is no longer applied to the doors 32, 34, the doors 32, 34 will return to their rest position located at approximately the middle of the door aperture. As shown in FIG. 2, the doors 32, 34 can be formed in a decorative shape, such as a saloon style door shape, and the like.

Figure 3:
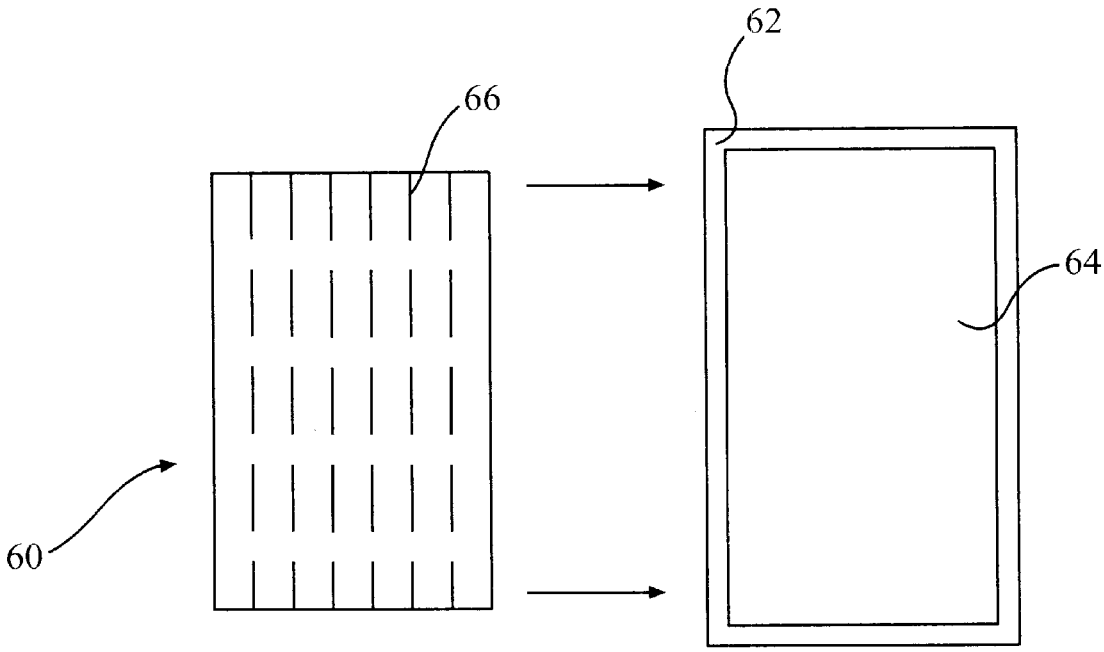
FIG. 3 shows a security system for a cubicle including a manually applied surface panel with perforations.

FIG. 3 illustrates a removable decorative panel, shown generally at 60, that can be applied to the collapsible door systems 10, 30. The decorative panel 60 can be applied to a removable panel frame 62 for the doors 12, 32, 34. The panel frame 62 preferably includes a frame material 64 which attracts and holds the removable decorative panel 60 to the panel frame 62. The decorative panel 60 may include one or more partitions 66 to allow the panel 60 to collapse and expand in a manner similar to the panels 14 of the doors 12, 32, 34.

It will be appreciated that the invention is not limited by the indicia on the decorative panel 60. For example, the decorative panel 60 can be produced with permanent panels that can have logos, advertisements, pictures, "white board" finish, symbols, cork board, pictures of art of all forms, likenesses of celebrities, figures of cars and other entertainment objects and characters. The panel 60 can be translucent, opaque, or transparent. The removable panel 60 could be made of plastic, wood, metal, or other materials. The panel 60 can be illuminated they can be computer controlled displays, or contain fluids and other objects.

In addition, the consumer of the collapsible security system 10, 30, can add removable panels with the same features as those mentioned above for the permanent decorative or descriptive panels. In the case of the removable decorative or descriptive panels 60, the consumer could purchase the removable panel 60 and then apply them to the collapsible security system 10, 30. The buyer would be able to add and remove the removable panels at their discretion. The removable panels 60 can be purchased separately, much like the purchase of posters. The removable panel 60 may need to have perforations on them so that they can be separated when they are applied to the collapsible security system 10, 30 because the removable panel 60 may bind the collapsible security system 10, 30. The removable panel 60 may be purchased but not be immediately applied to the collapsible security system 10, 30. In that case, a removable panel frame (not shown) can be sold separately so that the consumer can apply the removable panel 60 to a formal display so as to display the subject of the removable panel 60. The removable panel frame could have the same characteristics as the collapsible door system panels 14, as mentioned earlier in this description of FIG. 3. The removable panel could be attached to the collapsible door system or to the removable panel frame with static electricity, adhesive, or other means. These same means would be the way that the removable panels would be applied to the removable panel frame.

As described above, the security system 10, 30 can be used in the home as a door for children and teenagers' bedrooms and as a door for their closets, where decorative panels would be permanently and/or manually placed on the panels of the door. This would personalize the door for them. The security system 10, 30 can be used in a commercial setting as a closet door, rest room stall door, department store dressing room door, storage cabinet door, filing cabinet door, bookcase door, credenza door, wall partitions, building walls, window blinds, changing billboard signs, movable ad signs in buildings, store ad signs, greenhouse panels and doors, stretched roofing material, hiding panel in back of automobiles, snow fencing with holes in panels, camper wall partitions, outdoor wind breaker, animal shelters, tree trunk protectors, garage doors, barn doors, Quonset hut designs, boat panels, boat walls, boat coverings, plane hangars, dam and weir interlocked partitions and waterproof seals, hurricane fencing, orange traffic barrels, awnings, patio construction, interlocking home wooden/plastic/metal board fencing road safety compressible barriers, highway visual blinders on top of centerline piling, air filters of all types (allowing quick changing when old filter is dirty), patio roof sun blockers car and house sun roofs, sandbox sieves, sieves of all sorts, shower curtains, solar panels, gates of all sorts, patio furniture, and furniture of all kinds.

There are many advantages for the use of the security system 10, 30. One advantage is that it can be built and sold at a low cost. Another advantage is that it takes up virtually no room for storage. Yet another advantage is that it can be adapted to existing cubicles at minimum cost.

In summary, the invention provides a low cost way to secure a cubicle for computers, data, and other office supplies. In addition, it provides the occupant of a cubicle with privacy for their information, business items, and personal items.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A cubicle parition and folding door system, comprising:

first and second vertically-oriented wall frames disposed on separate spaced apart partitions, the wall frames being stationary relative to the partitions and defining a cubicle doorway; and a door including a plurality of folding panels, wherein a first panel is mounted to the first veritcally-oriented wall frame and each successive panel is supported solely by its preceding panel;

wherein, when the panels are folded together at the first wall frame, access is allowed to the cubicle through the doorway, and when the panels are unfolded to extend across the doorway to the second wall frame, access through the doorway to the cubicle is blocked.

2. The system of claim 1, wherein the furthest extended panel of the plurality of folding panels is capable of being connected to the second wall frame when the panels are unfolded across the doorway.

3. The system of claim 1, further comprising a locking bar that allows the panels to stay unfolded.

4. The panel system of claim 1, further comprising a decorative panel removably attached to the folding panels for changing an appearance of the panels.

5. A cubicle, comprising:

a plurality of partitions attached to one another forming an office space;

first and second vertically-oriented wall frames disposed on separate spaced apart partitions, the wall frames being stationary relative to the partitions and defining a cubicle doorway; and a door including a plurality of collapsible panels, wherein a first panel is mounted to the first vertically-oriented wall frame and each successive panel is supported solely by its preceding panel;

wherein, when the panels are folded together at the first wall frame, access is allowed to the cubicle through the doorway, and when the panels are unfolded to extend across the doorway to the second wall frame, access through the doorway to the cubicle is blocked.

6. The cubicle of claim 5, wherein the furthest extended panel of the plurality of folding panels is capable of being connected to the second wall frame when the panels are unfolded across the doorway.

7. The cubicle of claim 5, further comprising a locking bar that allows the panels to stay unfolded.

8. The cubicle of claim 5 further comprising a decorative panel removably attached to the folding panels for changing an appearance of the folding panels.

9. A cubicle partition and folding door system, comprising:

first and second vertically-oriented wall frames disposed on separate spaced apart partitions, the wall frames defining a cubicle doorway;

a first plurality of folding panels having a first panel supported by the first wall frame and each successive panel is supported solely by its preceding panel;

a second plurality of folding panels having a first panel supported by the second wall frame and each successive panel is supported solely by its preceding panel;

wherein, when the first and second plurality of panels are folded together at the wall frames, access is allowed to the cubicle, and when the first and second plurality of panels are unfolded to extend across the doorway, each panel having a furthest extended panel coming together, access through the doorway to the cubicle is blocked.

10. The system of claim 9, wherein the folding panels are capable of being locked together when the panels are unfolded across the doorway.

11. The system of claim 9, further comprising a first and second locking bar that allows the respective folding panels to stay unfolded.

12. The system of claim 9, further comprising decorative panels removably attached to the panels for changing an appearance of the panels.

13. A cubicle, comprising:

a plurality of partitions attached to one another forming an office space;

first and second vertically-oriented wall frames disposed on separate spaced apart partitions, the wall frames defining a cubicle doorway;

a first plurality of folding panels having a first panel supported by the first wall frame and each successive panel is supported solely by its preceding panel; and a second plurality of folding panels having a first panel supported by the second wall frame and each successive panel is supported solely by its preceding panel;

wherein, when the first and second plurality of panels are folded at the respective wall frames, access is allowed to the cubicle through the doorway, and when the first and second plurality of panels are unfolded to extend across the doorway, each panel having a furthest extended panel coming together, access through the doorway to the cubicle is blocked.

14. The cubicle of claim 13, wherein the folding panels are capable of being locked together when the panels are unfolded across the doorway.

15. The cubicle of claim 13, further comprising a first and second locking bar that allows the respective folding panels to stay unfolded.

16. The cubicle of claim 13, further comprising decorative panels removably attached to the panels for changing an appearance of the folding panels.

* * * * *